US007403729B2

(12) United States Patent
Shida

(10) Patent No.: US 7,403,729 B2
(45) Date of Patent: Jul. 22, 2008

(54) IMAGE FORMING APPARATUS FEATURING FIRST AND SECOND CLEANING MEMBERS WHEREIN A VOLTAGE APPLIED TO THE SECOND CLEANING MEMBER IS CHANGEABLE

(75) Inventor: Masanori Shida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 302 days.

(21) Appl. No.: 11/251,797

(22) Filed: Oct. 18, 2005

(65) Prior Publication Data

US 2006/0083531 A1 Apr. 20, 2006

(30) Foreign Application Priority Data

Oct. 20, 2004 (JP) ..... 2004-306252

(51) Int. Cl.
*G03G 15/00* (2006.01)

(52) U.S. Cl. ..... 399/71; 399/343; 399/354

(58) Field of Classification Search ..... 399/38, 399/71, 107, 123, 343, 350, 352, 353, 354; 15/256.5, 256.51
See application file for complete search history.

(56) References Cited

U.S. PATENT DOCUMENTS

| | | | | |
|---|---|---|---|---|
| 5,519,480 | A * | 5/1996 | Thayer et al. | 399/355 |
| 5,646,717 | A | 7/1997 | Hiroshima et al. | 399/154 |
| 6,167,215 | A | 12/2000 | Miyashiro et al. | 399/66 |
| 6,311,031 | B1 | 10/2001 | Hirano | 399/101 |
| 6,741,821 | B2 * | 5/2004 | Sugino et al. | 399/111 |
| 6,744,994 | B2 * | 6/2004 | Yoshikawa et al. | 399/44 |
| 7,215,920 | B2 * | 5/2007 | Shida | 399/354 |
| 7,251,430 | B2 * | 7/2007 | Nishikawa | 399/71 |

FOREIGN PATENT DOCUMENTS

| | | | |
|---|---|---|---|
| JP | 05-6112 | | 1/1993 |
| JP | 6-130875 | * | 5/1994 |
| JP | 2000-200022 | | 7/2000 |
| JP | 2000-275983 | | 10/2000 |
| JP | 2002-207403 | | 7/2002 |
| JP | 2002-229344 | | 8/2002 |
| JP | 2003-66735 | | 3/2003 |

* cited by examiner

*Primary Examiner*—Hoan H Tran
(74) *Attorney, Agent, or Firm*—Fitzpatrick, Cella, Harper & Scinto

(57) ABSTRACT

An image forming apparatus including an image bearing member bearing thereon a toner image charged to a predetermined polarity, a transferring device for electrostatically transferring the toner image borne on the image bearing member to a recording material, first and second cleaning members for electrostatically removing from the image bearing member any toner residual on the image bearing member when the toner image is transferred to the recording material, a first power supply for applying a bias of the same polarity as the predetermined polarity to the first cleaning member, a second power supply for applying a bias of a polarity opposite to the predetermined polarity to the second cleaning member, and a controller for variably controlling the condition of the bias applied to the first cleaning member and the condition of the bias applied to the second cleaning member independently of each other.

4 Claims, 7 Drawing Sheets

IMAGE FORMING APPARATUS FEATURING FIRST AND SECOND CLEANING MEMBERS WHEREIN A VOLTAGE APPLIED TO THE SECOND CLEANING MEMBER IS CHANGEABLE

BACKGROUND OF THE INVENTION

1. Field of the Invention

The invention relates to an image forming apparatus of an electrophotographic printing method or an electrostatic recording method such as, for example, a copying machine, a printer or a facsimile apparatus, and particularly to an image forming apparatus in which a toner on an image bearing member is electrostatically removed.

2. Description of Related Art

In recent years, as a plural-color or full-color image forming apparatus adopting an electrophotographic printing method, there has been proposed an image forming apparatus of a so-called intermediate transfer type in which toner images of respective colors formed on an image bearing member such as a photosensitive drum are successively superposed one upon another on an intermediate transfer member to thereby form a color image thereon, and the color image is collectively transferred to a recording material.

In such intermediate transfer type, a toner image is formed on the photosensitive drum by charging means, exposing means and developing means disposed around the photosensitive drum. Then, the toner image on the photosensitive drum is electrostatically transferred to an intermediate transfer member such as an intermediate transfer belt in a primary transfer portion by transferring means. Also, yellow, magenta, cyan and black toner images can be successively transferred to the intermediate transfer member to thereby form a full-color image on the intermediate transfer member.

The toner image transferred to the intermediate transfer member is carried to a secondary transfer portion by the rotation of the intermediate transfer member, and is electrostatically transferred to a recording material. As a method of removing any toner not transferred to the recording material at this time but residual on the intermediate transfer member (untransferred residual toner), there is a method of urging a cleaning blade against the intermediate transfer member to thereby remove the residual toner. There has also been proposed a method of applying a bias to a cleaning member to thereby electrostatically remove the residual toner.

The method of electrostatically removing the toner is advantageous to such a problem as the influence upon the life of the intermediate transfer member which poses a problem when the toner is removed by blade cleaning means, or the fluctuation of a load by the fluctuation of frictional resistance.

Here, as regards the charging polarity of the untransferred residual toner after secondary transfer, there are the toner charged to the positive polarity and the toner charged to the negative polarity.

So, two cleaning members are used to collect both of the untransferred residual toner charged to the positive polarity and the untransferred residual toner charged to the negative polarity to thereby sufficiently remove the untransferred residual toner.

Biases of different polarities are applied to the two cleaning members. That is, a bias of the positive polarity is applied to one of the two cleaning members, and a bias of the negative polarity is applied to the other cleaning member. In this manner, the untransferred residual toner after the secondary transfer is sufficiently removed. However, there has arisen the problem that even if as described above, two cleaning members are provided and biases of different polarities are applied to these two cleaning members, when image formation is continuedly effected, the untransferred residual toner after the secondary transfer becomes incapable of being sufficiently collected.

SUMMARY OF THE INVENTION

It is an object of the present invention to make it possible to sufficiently effect the collection of an untransferred residual toner even when image formation is continuedly effected in an image forming apparatus wherein the untransferred residual toner on an image bearing member is removed by the use of two cleaning members to which biases of different polarities are applied.

It is another object of the present invention to provide an image forming apparatus having:

an image bearing member bearing thereon a toner image charged to a predetermined polarity;

transferring means for electrostatically transferring the toner image borne on the image bearing member to a recording material;

first and second cleaning members for electrostatically removing from the image bearing member toner residual on the image bearing member when the toner image is transferred to the recording material;

a first power supply for applying a bias of the same polarity as the predetermined polarity to the first cleaning member;

a second power supply for applying bias of a polarity opposite to the predetermined polarity to the second cleaning member; and controlling means for variably controlling the condition of the bias applied to the first cleaning member and the condition of the bias applied to the second cleaning member independently of each other

DETAILED DESCRIPTION OF THE PREFERRED EMBODIMENTS

In the present invention, the above-noted problem was solved by providing "controlling means for variably controlling the condition of the bias applied to the first cleaning member and the condition of the bias applied to the second cleaning member independently of each other".

That is, when a bias is applied to a cleaning member and image formation is continuedly effected, a toner adheres to the cleaning member. By the adherence of the toner, the electrical resistance of the cleaning member is changed and the optimum condition of a bias for removing any untransferred residual toner is changed.

Also, the untransferred residual toner of the positive polarity and the untransferred residual toner of the negative polarity are not equal in amount to each other. Accordingly, the amount of untransferred residual toner adhering to the cleaning member to which a bias of the positive polarity is applied and the amount of untransferred residual toner adhering to the cleaning member to which a bias of the negative polarity is applied differ from each other. That is, the manner of change in the optimum condition of the bias applied to the first cleaning member and the manner of change in the optimum condition of the bias applied to the second cleaning member differ from each other.

So, by adopting "controlling means for variably controlling the condition of the bias applied to the first cleaning member and the condition of the bias applied to the second cleaning member independently of each other", it was made possible to sufficiently remove the untransferred residual toner of the opposite polarity and the untransferred residual toner of the negative polarity to thereby solve the above-noted problem.

An image forming apparatus according to the present invention will hereinafter be described in greater detail.

Embodiments hereinafter described are examples of the best embodiment of the present invention, but the present invention is not restricted to these embodiments.

Embodiment 1

Figure 1:
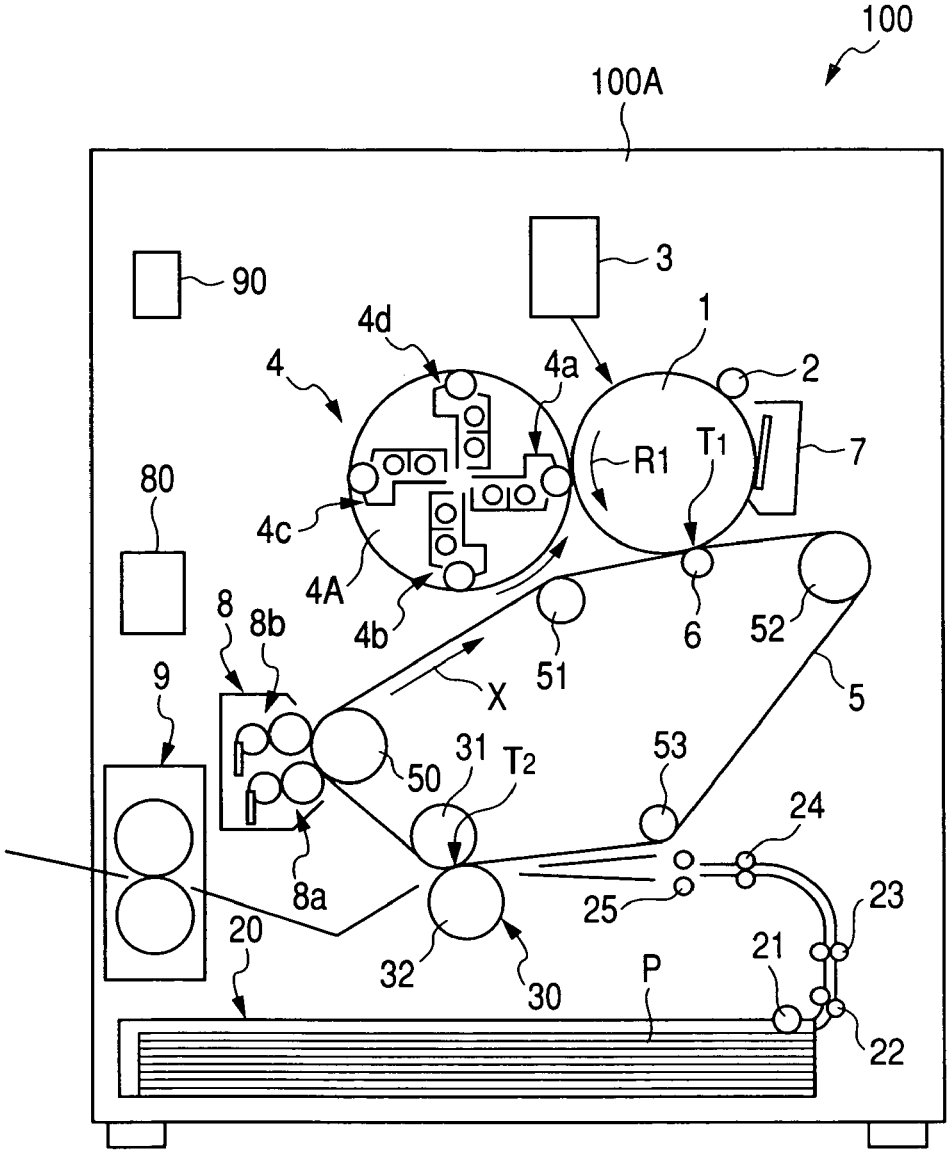
FIG. 1 is a cross-sectional view schematically showing the construction of an embodiment of the image forming apparatus of the present invention.

FIG. 1 schematically shows the construction of an embodiment of the image forming apparatus according to the present invention. In this embodiment, the image forming apparatus 100 is an electrophotographic image forming apparatus using an intermediate transfer member.

In the present embodiment, in an image forming apparatus main body 100A, there is disposed an endless intermediate transfer belt (intermediate transfer member or image bearing member) 5 passed over supporting rollers 50, 51, 52, 53 and 31 and moved in the direction indicated by the arrow X.

This intermediate transfer belt 5 is formed of dielectric material resin such as polycarbonate, polyethylene terephthalate resin film, polyvinylidene fluoride resin film, polyimide, or ethylene tetrafluoroethylene copolymer.

The present embodiment adopts an electrically conductive polyimide seamless belt having volume resistivity of $1\times10^9$ Ω·cm (measured by the use of a probe conforming to JIS-K6911 method, applied voltage 500 V, application time 60 sec.), and a thickness of 80 μm, but use may be made of a belt of other material having other volume resistivity and other thickness.

In some cases, the intermediate transfer belt 5 having an elastic layer as a surface layer cannot adopt blade cleaning as cleaning means therefore, but in the present embodiment, as will be described later, electrostatic type fur brush cleaning means is used as cleaning means and therefore, blade cleaning can be suitably used.

A recording material P taken out of a sheet supplying cassette 20 is fed to a secondary transfer portion T2 in which there is disposed a secondary transfer roller 32 as secondary transferring means, by conveying rollers 22-25 via a pickup roller 21. The secondary transfer roller 32 is disposed in opposed relationship with the supporting roller 31 functioning also as an opposed roller, and nips the intermediate transfer belt 5 between itself and the supporting roller 31.

Figure 2:
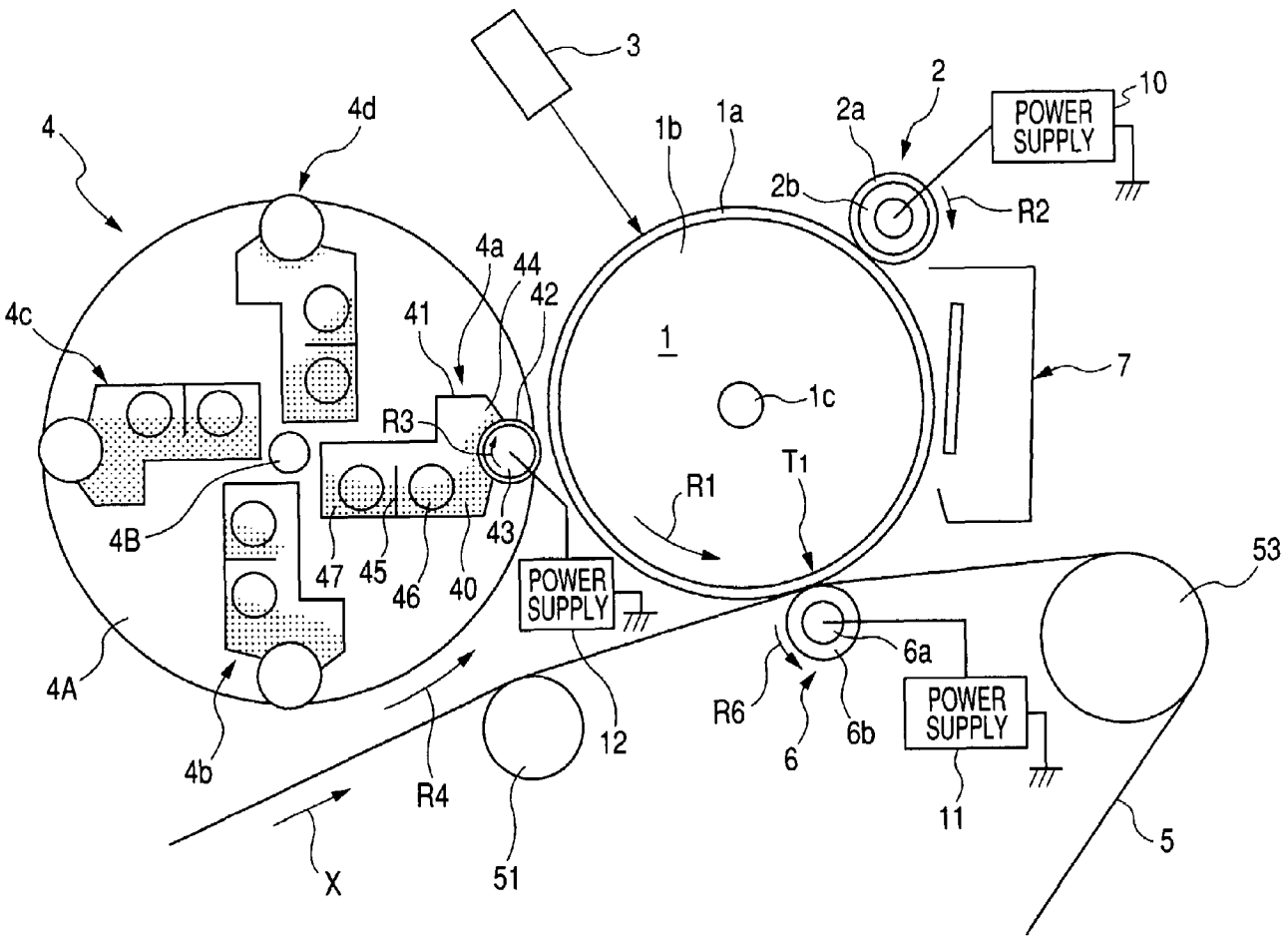
FIG. 2 shows the image forming portion of the image forming apparatus of the present invention.

An image forming portion will now be described with reference to FIG. 2.

In the present embodiment, the image forming portion is provided with a rotatably disposed drum-shaped electrophotographic photosensitive member (hereinafter referred to as the "photosensitive drum") 1 as an image bearing member. The photosensitive drum 1 is a cylindrical electrophotographic photosensitive member provided with an electrically conductive base 1*b* of aluminum or the like and a photoconductive layer 1*a* formed on the outer periphery thereof, as a basic construction. The photosensitive drum 1 has a supporting shaft 1*c* at the center thereof, and is rotatively driven in the direction indicated by the arrow R1 about this supporting shaft 1*c* by driving means (not shown).

Around the photosensitive drum 1, there are disposed process apparatuses such as a primary charger 2 as primary charging means, an exposing apparatus 3 like a laser beam scanner as exposing means, and a developing apparatus 4 as developing means.

In the present embodiment, the primary charger 2 is a charging roller contacting with the surface of the photosensitive drum 1 and formed into a roller shape as a whole for uniformly charging the surface of the photosensitive drum 1 to a predetermined polarity and predetermined potential. In the present embodiment, the photosensitive drum 1 is charged to the negative polarity.

The charging roller 2 has an electrically conducting roller (mandrel) 2*b* disposed at the center thereof, and an electrically conducting layer 2*a* formed on the outer periphery thereof, and has its opposite end portions of the mandrel 2*b* rotatably supported by bearing members (not shown), and also is disposed in parallelism to the photosensitive drum 1. The bearing members at these opposite end portions are biased toward the photosensitive drum 1 by pressing means (not shown), whereby the charging roller 2 is brought into pressure contact with the surface of the photosensitive drum 1 with a predetermined pressure force.

The charging roller 2 is driven to rotate in the direction indicated by the arrow R2 by the rotation of the photosensitive drum 1 in the direction indicated by the arrow R1. An electrical contact connected to a power supply 10 is brought into contact with the mandrel 2*b* of the charging roller 2. The charging roller 2 has a bias voltage applied thereto by the power supply 10 to thereby uniformly contact-charge the surface of the photosensitive drum 1. Then, by image exposure from the exposing means 3, an electrostatic latent image is formed on the photosensitive drum 1.

In the present embodiment, the developing apparatus 4 disposed downstream of the exposing means 3 is a rotary developing apparatus, and is provided with a rotary member 4A rotatable about a rotary shaft 4B. A plurality of, in the present embodiment, four developing devices 4*a*, 4*b*, 4*c*, and 4*d* are carried on the rotary member 4A, and accordingly, the rotary member can be rotated by 90° each in the direction indicated by the arrow R4 about the rotary shaft 4B to thereby move the developing devices 4*a*, 4*b*, 4*c*, and 4*d* to a position opposed to the photosensitive drum 1 (developing position) in the named order, and develop the electrostatic latent image formed on the photosensitive drum 1 as a developer image (toner image).

The developing devices 4*a*, 4*b*, 4*c*, and 4*d* are of the same construction and therefore, the developing device 4*a* will now be described.

The developing device 4*a* has a developer container 41 containing a developer 40 therein, and a developing sleeve 42 as a developer carrying member is installed in the opening portion of the container 41 which faces the photosensitive drum 1 for rotation in the direction indicated by the arrow R3. In the developing sleeve 42, a magnet roller 43 for causing the developer to be carried on the developing sleeve is fixedly disposed so as to be irrotational against the rotation of the developing sleeve 42.

Above the developing sleeve 42 of the developer container 41, there is installed a regulating blade 44 for regulating the developer carried on the developing sleeve 42 to thereby form it into a thin developer layer.

In the developer container 41, there are provided a developing chamber 46 and an agitating chamber 47 comparted in a substantially lower half portion thereof by a partition wall 45.

In the present embodiment, the developer 40 is a dual-component developer consisting chiefly of a toner and a carrier which is a magnetic material. The toner is negatively chargeable, and the carrier is positively chargeable. That is, the toner is charged to the negative polarity.

First, with the rotation of the developing sleeve 42, the developer 40 in the developing chamber 46 is scooped up by the magnetic poles of the magnet roller 43, and is carried onto the developing sleeve 42. The developer 40 is carried by the rotation of the developing sleeve 42, and in the carrying process thitherto, the toner is negatively charged and also, the developer 40 is regulated by the regulating blade 44 disposed perpendicularly to the developing sleeve 42, is formed into a thin developer layer. The developer 40 formed into the thin developer layer, when carried to the developing area opposed to the photosensitive drum 1, is stood like ears of rice by the magnetic force of the developing main pole of the magnet roller 43 which is located in the developing area, and the magnetic brush of the developer 40 is formed. The surface of the photosensitive drum 1 is rubbed by this magnetic brush and also, a developing bias voltage is applied to the developing sleeve 42 by a bias voltage source 12, whereby the toner adhering to the carrier forming the ears of the magnetic brush adheres to and develop the visible portion (exposed portion by a laser beam) of the electrostatic latent image, whereby a toner image is formed on the photosensitive drum 1.

Below the photosensitive drum 1, there is disposed a roller-shaped transferring apparatus (hereinafter referred to as the "transfer roller") 6 constituting primary transferring means.

The transfer roller 6 is constituted by an electrical conductor roller shaft 6*a* connected to a power supply 11, and an electrically conducting layer 6*b* formed into a cylindrical shape on the outer peripheral surface thereof. As the material of the electrically conducting layer 6*b* of the transfer roller 6, closed-cell or open-cell EPDM, SBR, BR or the like having a resistance value of the order of $10^5$-$10^8$ Ω·cm is desirable. The transfer roller 6 has its opposite end portions biased toward the photosensitive drum 1 by pressing members (not shown) such as springs, whereby the electrically conducting layer 6*b* of the transfer roller 6 is brought into pressure contact with the photosensitive drum 1 with a predetermined pressure force so as to nip the intermediate transfer belt 5 therebetween, and a transfer nip portion, i.e., a primary transfer portion T1, is formed.

The other developing devices 4*b*, 4*c*, and 4*d* are similar in construction to the developing device 4*a*, and the difference the among these developing devices 4*a*, 4*b*, 4*c*, and 4*d* is that they form toner images of respective colors, i.e., yellow, magenta, cyan, and black.

It is to be understood that a yellow toner, a magenta toner, a cyan toner and a black toner are contained in the developing devices 4*a*, 4*b*, 4*c*, and 4*d*, respectively.

An image signal by the yellow component color of an original is projected onto the photosensitive drum 1 via a polygon mirror (not shown) or the like and an electrostatic latent image is formed thereon, and the yellow toner is supplied thereto from the developing device 4*a* and the electrostatic latent image becomes a yellow toner image. When this toner image comes to the primary transfer portion T1 in which the photosensitive drum 1 and the intermediate transfer belt 5 contact with each other, with the rotation of the photosensitive drum 1, the yellow toner image is transferred to the intermediate transfer belt 5 by a transfer bias applied to the transfer roller 6.

The intermediate transfer belt 5 thus bearing the yellow toner image thereon makes one revolution and is again conveyed to the primary transfer portion T1. By this time, the developing apparatus 4 is rotated by 90° in the direction indicated by the arrow R4 about the rotary shaft 4B to thereby move the developing device 4*b* to the position opposed to the photosensitive drum, whereby in a manner similar to that previously described, a magenta toner image is formed on the photosensitive drum 1. This magenta toner image is transferred onto the yellow toner image on the intermediate transfer belt 5.

Likewise, a cyan toner image and a black toner image are superposed and transferred onto the aforedescribed toner images, and the recording material P taken out of the sheet supplying cassette 20 by this time arrives at the secondary transfer portion T2, and the above-described toner images of the four colors are secondary-transferred onto the recording material P.

Figure 3:
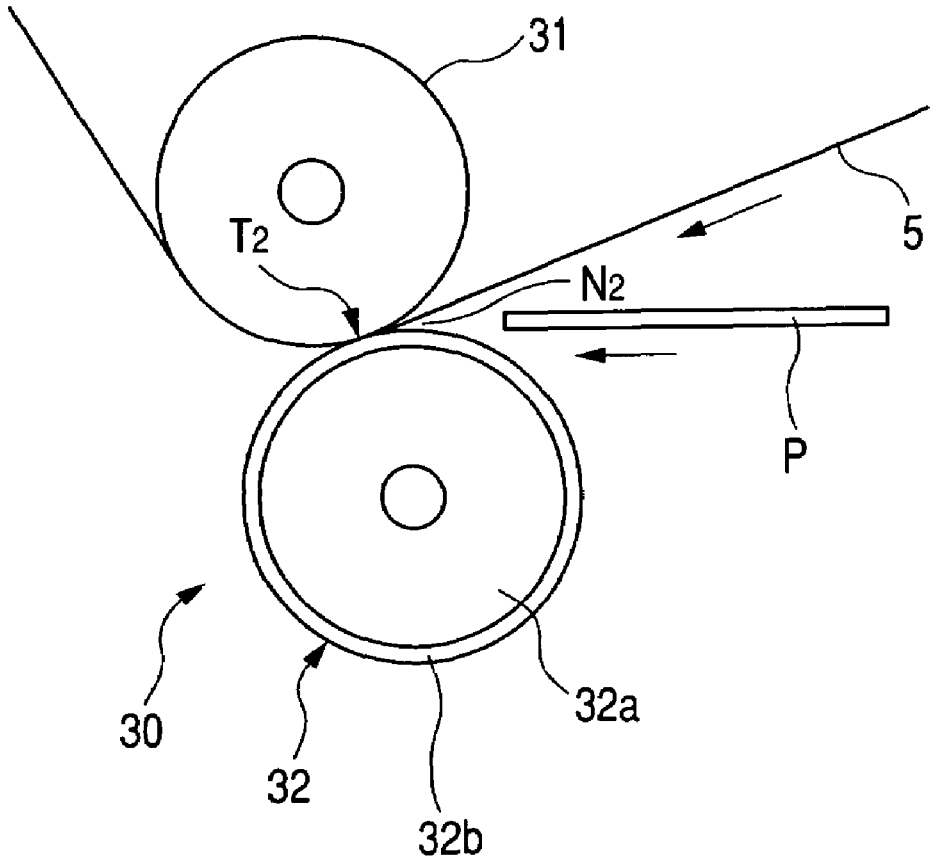
FIG. 3 shows the secondary transfer portion of the image forming apparatus of the present invention.

FIG. 3 shows the construction of secondary transferring means (transferring means) 30 disposed in the secondary transfer portion T2.

The secondary transferring means 30 has a secondary transfer inner roller 31 which is a secondary transfer member serving also as a belt stretching roller located inside the intermediate transfer belt 5, and a secondary transfer outer roller 32 which is a secondary transfer member located outside the intermediate transfer belt 5.

The secondary transfer outer roller 32 is formed by an electrically conductive shaft 32*a* having a diameter of 24 mm, and an electrically conducting layer 32*b* covering the surface thereof. As the material of the electrically conducting layer 32*b* of the secondary transfer outer roller 32, solid or expandable EPDM, SBR, BR or the like having a resistance value of the order of $10^5$-$10^7$ Ω·cm is desirable. The secondary transfer inner roller 31 is an electrically conductive roller and it is preferable that the diameter thereof be 21 mm and the material thereof be SUS, Al or the like.

A transferring bias is applied to one of the secondary transfer inner roller 31 or the secondary transfer outer roller 32 to thereby transfer the toners on the intermediate transfer belt 5 onto the recording material P passing through the secondary transfer portion T2, and in the present embodiment, a positive bias is applied to the secondary transfer outer roller 32 to thereby transfer the toners charged to the negative polarity from the intermediate transfer belt 5 onto the recording material P.

The secondary transfer outer roller 32 is movable toward and away from the intermediate transfer belt 5, and is spaced apart from the belt 5 when the yellow, magenta, cyan, and black toner images are being superposedly formed on the intermediate transfer belt 5, and is brought into contact with the belt 5 when the superposed full-color toner image on the intermediate transfer belt 5 is transferred to the recording material p.

Residual toners not transferred to the recording material P but residual on the intermediate transfer belt 5 are carried to a cleaning portion using the intermediate transfer member cleaning apparatus 8 by the rotation of the belt 5.

Figure 4:
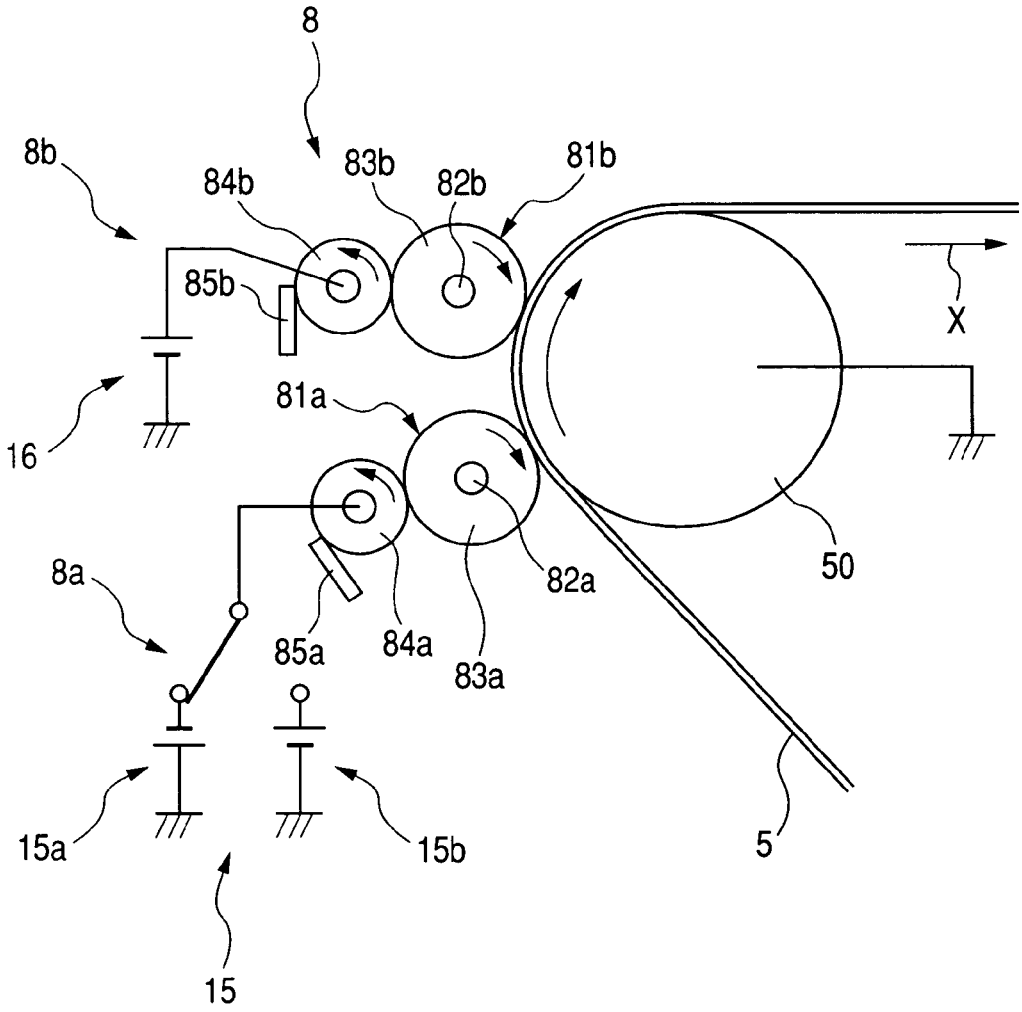
FIG. 4 schematically shows the construction of the intermediate transfer member cleaning apparatus of the image forming apparatus of the present invention.

As shown in detail in FIG. 4, in the present embodiment, the intermediate transfer member cleaning apparatus 8 is disposed in opposed relationship with a supporting roller 50 supporting the intermediate transfer belt 5. The intermediate transfer member cleaning apparatus 8 is provided with a plurality of cleaning means, and in the present embodiment, it has a first cleaning device 8*a* as first cleaning means located upstream with respect to the conveying direction of the intermediate transfer belt 5, and a second cleaning device 8*b* as second cleaning means located downstream.

In the present embodiment, the intermediate transfer member cleaning apparatus 8 is an electrostatic type fur brush cleaning apparatus, and a plurality of, in the present embodiment, two fur brushes (cleaning members) 81 (81*a* and 81*b*) are disposed upstream and downstream with respect to the conveying direction of the belt 5.

The intermediate transfer member cleaning apparatus 8, like the secondary transfer outer roller 32, is also movable toward and away from the intermediate transfer belt 5, and when the residual toners on the intermediate transfer belt 5 have been carried to the cleaning portion of the intermediate transfer member cleaning apparatus 8, the fur brushes 81 are brought into contact with the intermediate transfer belt 5. Also, the inroad amount of the fur brushes 81 (81*a* and 81*b*) into the surface of the intermediate transfer belt 5 is about 1.0 mm.

The fur brushes 81 (81*a* and 81*b*) used in the present embodiment are constituted by electrically conducting shafts 82 (82*a* and 82*b*) having a diameter of 8 mm and implanted with electrically conductive and fiber-like hairs 83 (83*a* and 83*b*). The hairs 83 used has an outer diameter of 20 mm and a pile length of 6 mm, and is formed of nylon, and has density of 100 kF and resistance of $5\times10^6$ Ω.

Downstream of the points at which the fur brushes 81 (81*a* and 81*b*) contact with the belt stretching roller 50, metallic bias rollers 84 (84*a* and 84*b*) are disposed so as to enter the fur brushes 81 (81*a* and 81*b*). The inroad amount of the fur brushes 81 (81*a* and 81*b*) into the surfaces of the bias-rollers 84 at this time is about 1.0 mm.

Also, downstream of the points at which the metallic bias rollers 84 contact with the fur brushes 81, scrapers 85 (85*a* and 85*b*) are pressed against the metallic bias rollers 84 to thereby shift the toners collected by the fur brushes 81 to the metallic rollers 84, and scrape off the toners by the scrapers 85, thereby causing the toners to fall into a waste toner box (not shown).

As regards the rotation direction of each member, the fur brushes 81 (81*a* and 81*b*) are rotated in a direction counter to the movement direction of the belt, i.e., a clockwise direction as viewed in FIG. 4, at positions opposed to the intermediate transfer belt 5. Also, the bias rollers 84 (84*a* and 84*b*) are rotated in the same direction, i.e., a counter-clockwise direction as viewed in FIG. 4, at positions opposed to the fur brushes 81.

The delivery of the toners from the intermediate transfer belt 5 to the fur brushes 81 (81*a* and 81*b*) is effected in the following manner.

In the present embodiment, during ordinary image formation, a bias of the negative polarity (a bias of the same polarity as the charging polarity of the toners) is applied from the minus power supply 15*a* of a power supply 15 to the bias roller 84*a* upstream with respect to the rotation direction of the intermediate transfer belt 5, and a bias of the positive polarity (a bias of a polarity opposite to the charging polarity of the toners) is applied from a power supply 16 to the downstream bias roller 84*b*. In the present embodiment, −700 V is applied to the upstream bias roller 84*a*, and +700 V is applied to the downstream bias roller 84*b*. When the biases are applied to the fur brushes 81 through the bias rollers 84, the fur brushes 81 are in contact with the intermediate transfer belt 5.

In the present embodiment, there is the possibility that the residual toners on the intermediate transfer belt 5 after the termination of the secondary transfer include toners of the two polarities, i.e., the negative polarity and the positive polarity, and therefore, design is made such that biases of different polarities are applied to the two fur brushes 81*a* and 81*b*.

For example, describing the downstream cleaning portion, +700 V is applied to the bias roller 84*b*, as described above. Therefore, a voltage of +600 V is induced in the fur brush 81*b*, and a potential difference occurs between the fur brush 81*b* and the grounded belt stretching roller 50, and the toners on the intermediate transfer belt 5 shift to the fur brush 81*b*. Further, the toners collected by the fur brush 81*b* are shifted to the bias roller 84*b* by the potential difference between the fur brush 81*b* and the bias roller 84*b*.

Figure 5:
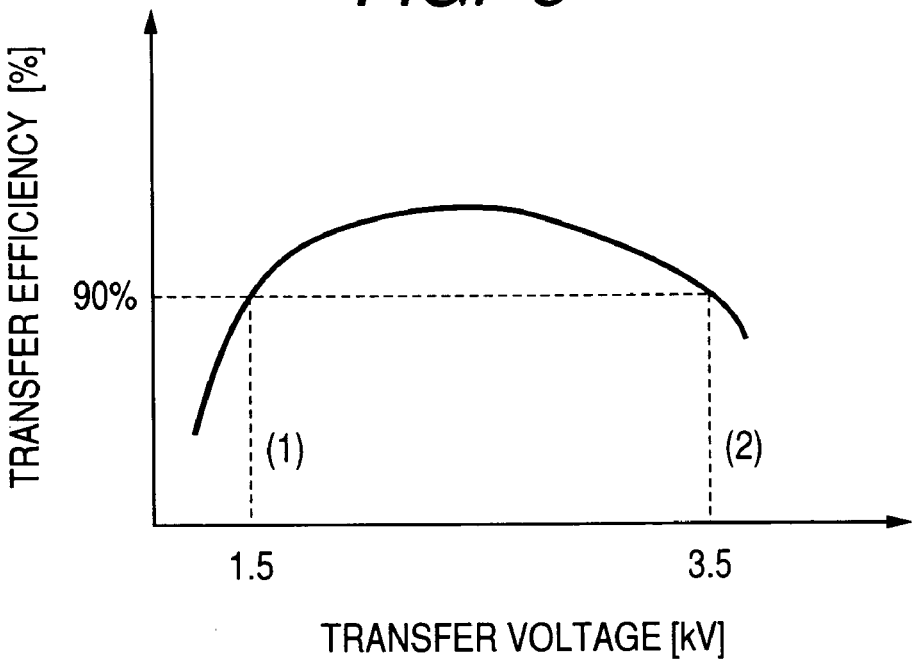
FIG. 5 is a graph showing the relation between a transfer voltage and transfer efficiency in the secondary transfer portion.

FIG. 5 is a graph showing the applied voltage to the secondary transfer roller 32 and transfer efficiency in the secondary transfer portion T2 in the present embodiment. Dotted lines (1) and (2) in this graph are indicative of the transfer voltage at transfer efficiency of 90%.

Here, the transfer efficiency was obtained by transfer efficiency =toner amount transferred to the recording material/toner amount on the intermediate transfer member before transfer×100 [%].

Voltages corresponding to the dotted lines (1) and (2) are 1.5 kV and 3.5 kV, thus differing in voltage value from each other, but the residual toners on the intermediate transfer member when the transferring voltage is set to 1.5 kV are chiefly toners of the negative polarity, and when the transferring voltage is 3.5 kV, the residual toners are chiefly toners of the positive polarity.

This is because when the transferring voltage is set to 1.5 kV, the transferring voltage is deficient relative to the charges of the transferred toners, and when the transferring voltage is set to 3.5 kV, the transferring voltage is too high, whereby the polarity of the charges of the toners is reversed by the injection of charges into the toners or the jumping of charges into the toners due to discharge.

By the reason set forth above, in the present embodiment, design is made such that two fur brushes 81*a* and 81*b* are disposed in the intermediate transfer member cleaning apparatus 8 and biases of different polarities are applied to the respective fur brushes 81*a* and 81*b*.

Description will hereinafter be made of a method of controlling the cleaning biases applied to the two fur brushes 81*a* and 81*b* in the intermediate transfer member cleaning apparatus 8 in the present embodiment.

In the intermediate transfer member cleaning apparatus 8 used in the present embodiment, the polarities of the toners collected by the upstream and downstream fur brushes 81*a* and 81*b* differ from each other. Therefore, when during image formation, originals high in original image density are many and when originals low in original image density are many, the manner in which the upstream and downstream fur brushes 81*a* and 81*b* are stained becomes different. Accordingly, the adjustment of the cleaning biases individually applied to the upstream and downstream fur brushes 81*a* and 81*b* must be effected.

Also, the cleaning biases in the present embodiment are controlled at a constant voltage. In the control at a constant voltage, electric current setting conforming to resistance becomes possible when the fur brushes are partly stained and a resistance difference occurs in the longitudinal direction of the fur brushes or when the collection of the untransferred residual toners differing in image percentage in the longitudinal direction is required.

Figure 6:
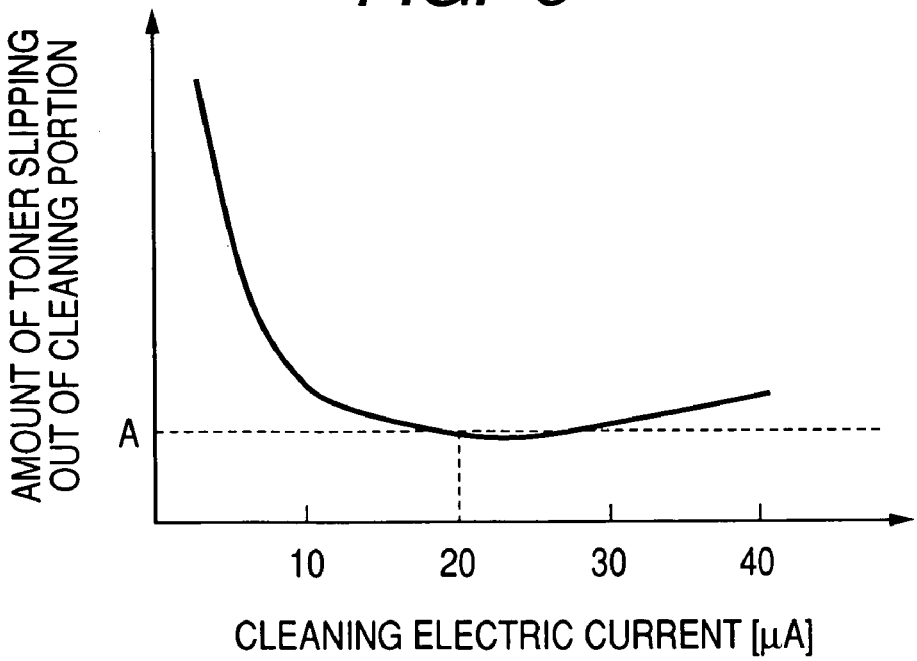
FIG. 6 is a graph showing the relation between a cleaning electric current and slipping-out density in the intermediate transfer member cleaning apparatus.

A cleaning electric current necessary to remove the untransferred residual toners on the intermediate transfer belt can be determined from the collectability of the untransferred residual toners when the cleaning electric current has been allotted, as shown in FIG. 6.

Faulty cleaning poses it as a problem for the untransferred residual toners on the intermediate transfer belt after secondary transfer to be not collected by the cleaning portion, but slip out therethrough. Further, it poses a problem that, the toner amount which has slipped out is an amount which will affect the next image formation and so on.

Accordingly, first, as shown in FIG. 6, slipping-out density (indicated by "A" in FIG. 6) at which the toner amount slipping out of the cleaning portion does not affect the image is set. The cleaning electric current value can be set to such an electric current value that slipping-out toner density becomes "A" or below, thereby preventing faulty cleaning. This proper electric current value is set for each of the fur brushes 81*a* and 81*b* when as in the present embodiment, there are a plurality of cleaning for brushes.

Cleaning bias control is effected by controlling the condition of the biases applied to the fur brushes 81 by the power supplies 15 and 16 by controlling means 80 during the non-passing of sheets before image formation is effected. That is, the cleaning bias voltages (monitor voltages) applied to the bias rollers 84*a* and 84*b*, i.e., the fur brushes 81*a* and 81*b*, are stepwisely changed, and the voltage-current relations of the respective fur brushes 81*a* and 81*b* are detected by detecting means 90. Then, on the basis of the result of the detection by the detecting means 90, the controlling means 80 variably control the condition of the biases applied to the fur brushes 81*a* and 81*b*.

Specifically, the monitor voltages are stepwisely changed, and an electric current value flowing to the opposed roller 50 is detected. The voltage value is changed so that the detected electric current value may become a proper electric current value obtained from the foregoing. When a voltage value corresponding to the proper electric current value has been found out, that voltage is used as the cleaning bias applied to the cleaning fur brushes during image formation.

For example, the proper electric current necessary for cleaning is defined as −20 μA to the upstream fur brush 81*a*, and defined as 20 μA to the downstream for brush 81*b*.

Figure 7:
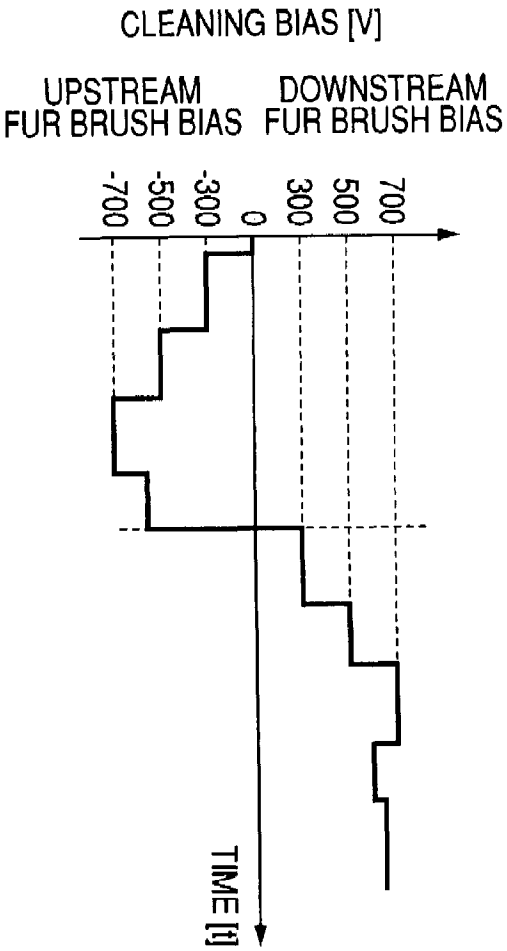
FIG. 7 illustrates a method of applying a cleaning bias.

For the proper electric current 20 μA, as shown in FIG. 7, voltages of −300 V, −500 V, and −700 V are applied to the upstream for brush 81*a*. In a case where the electric current values when these three voltages have been applied are −10 μA, −14 μA, and −21 μA, several voltages are further allotted between −600 V to −700 V, and at a point of time whereat it has been detected that the electric current value becomes 20 μA, the then voltage is applied as the cleaning bias to the upstream fur brush 81*a* during image formation.

In the manner described above, the cleaning bias to the upstream fur brush 81*a* is adjusted, whereafter 300 V, 500 V, and 700 V are likewise successively applied to the downstream fur brush 81*b*, and control similar to that for the upstream fur brush 81*a* is effected, and at a point of time whereat it has been detected that the electric current value becomes 20 μA, the then voltage is applied as the cleaning bias to the downstream fur brush 81*b* during image formation.

By the above-described method of the present embodiment, even when for example, image formation is progressed by a plurality of fur brushes to thereby cause unevenness to the stains of the fur brushes, a cleaning bias corresponding to a proper electric current can be set for each of the fur brushes.

Also, while in the present embodiment, the bias adjustment of the cleaning fur brushes has been effected from the upstream fur brush 81*a*, a similar effect can also be obtained if it is effected from the downstream fur brush 81*b*.

Also, while in case of bias adjustment, three +α voltages such as 300 V, 500 V, and 700 V have been stepwisely applied, the number of applied voltages can be further increased to thereby effect cleaning bias control of higher accuracy, and on the other hand, the number of applied voltages can be decreased to thereby effect cleaning bias control more simply and within a shorter time.

According to the present embodiment, the setting of a cleaning bias having taken into account the influence, i.e., interference, of the bias applied to proximate fur brushes, or the influence of the residual charges in the belt upon the upstream brush becomes possible. Further, by effecting bias control, it is possible to set a cleaning bias corresponding to a proper electric current even when for example, image formation is progressed by a plurality of fur brushes to thereby cause unevenness to the stains of the fur brushes.

Embodiments 2 and 3

In the above-described first embodiment (Embodiment 1) of the present invention, description has been made of a method of setting a cleaning bias corresponding to a proper electric current even when from the difference between the charging polarities of the respective collected toners, unevenness occurs to the stains of the fur brushes by image formation being progressed.

In a second embodiment (Embodiment 2) of the present invention, description will be made of a method of setting a cleaning bias corresponding to a proper electric current in a case where the upstream and downstream fur brush cleaning means 8*a* and 8*b* are disposed in proximity to each other, and the influence of residual charges in the belt the intermediate transfer belt 5 has received by the upstream cleaning fur brush 81*a* with respect to the rotation direction of the intermediate transfer belt is received by the downstream cleaning fur brush 81*b*.

Figure 8:
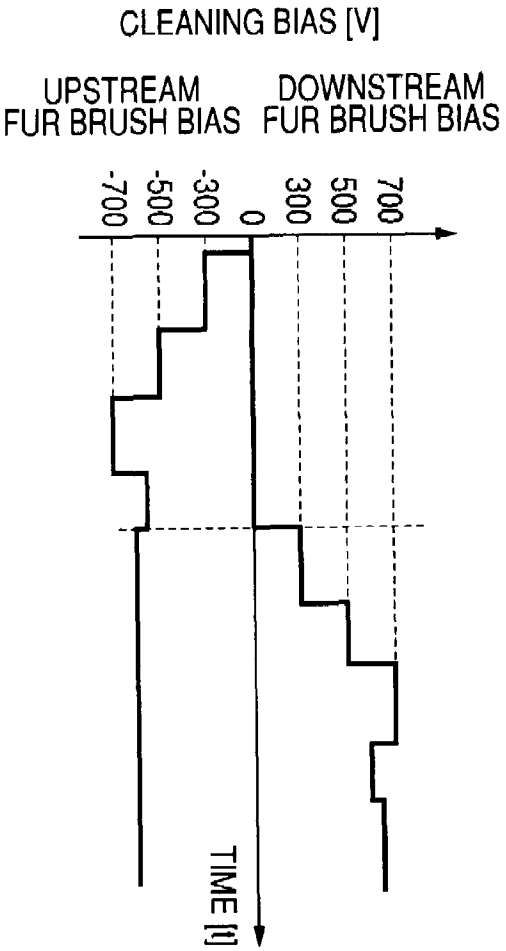
FIG. 8 illustrates a method of applying a cleaning bias.

As regards only the influence of the residual charges in the belt, there is only the influence of the upstream cleaning fur brush 81*a* upon the downstream cleaning fur brush 81*b* with respect to the rotation direction of the intermediate transfer belt and therefore, as shown in FIG. 8, the bias control of the upstream fur brush 81*a* is effected earlier, and the bias control of the downstream fur brush 81*b* is effected while an adjusted cleaning bias is applied thereto, whereby the setting of a cleaning bias having taken into account the influence of the residual charges the belt has received at the upstream fur brush position becomes possible.

Further, in a third embodiment (Embodiment 3) of the present invention, description will be made of a method of setting a cleaning bias corresponding to a proper electric current in a case where the upstream and downstream cleaning fur brushes 81*a* and 81*b* are disposed in proximity to each other and further, there is the influence of interfere.

Figure 9:
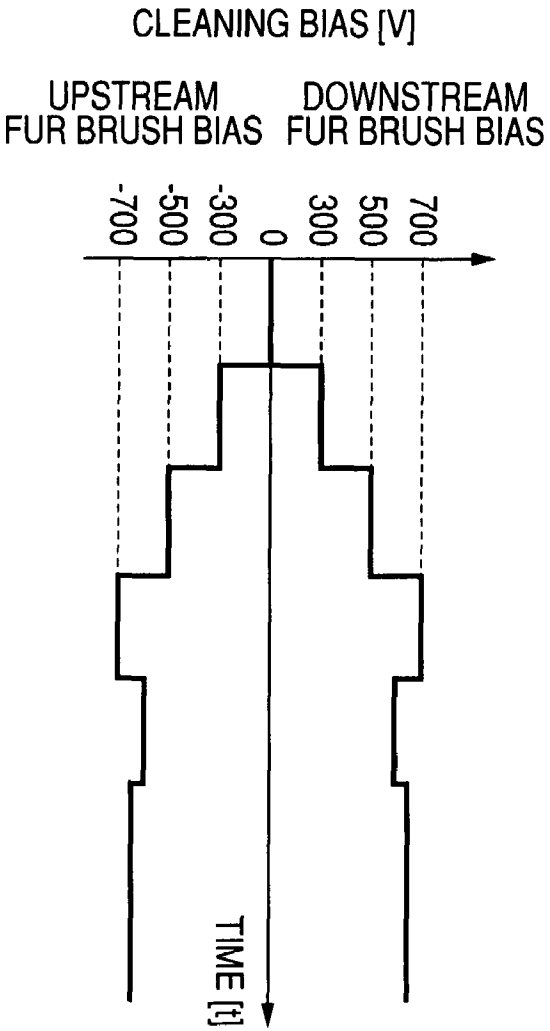
FIG. 9 illustrates a method of applying a cleaning bias.

In Embodiment 3, as shown in FIG. 9, bias values are changed at a time for both of the upstream and downstream cleaning brushes 81*a* and 81*b*, and voltages are changed so as to be converged into respective proper electric currents, whereby it is possible to obtain a result having taken into account the influence, i.e., interference, of the biases applied to the respective cleaning fur brushes 81*a* and 81*b*, or the influence of the charges of the upstream fur brush 81*a* residual in the belt.

First, it is to be understood that the proper electric current necessary for cleaning is −20 μA to the upstream fur brush 81*a*, and is 20 μA to the downstream fur brush 81*b*.

For the proper electric current 20 μA, as shown in FIG. 9, voltages of −300 V, −500 V, and −700 V are applied at a time to the upstream fur brush 81*a*, and voltages of 300 V, 500 V, and 700 V are applied at a time to the downstream fur brush 81*b*. When the electric currents when such voltages have been applied are detected to be −10 μA, −14 μA, and −21 μA in the upstream fur brush 81*a*, and are detected to be 12 μA, 17 μA, and 25 μA in the downstream fur brush 81*b*, several voltage between −600 V to −700 V are allotted to the upstream fur brush 81*a*, and a voltage between 600 V to 700 V is allotted to the downstream fur brush 81*b*. Then, at a point of time whereat 20 μA has been detected as the electric current, the then voltage is applied as a transfer belt cleaning voltage during image formation.

That is, the cleaning bias control in the present embodiment is effected by controlling the conditions of the biases applied to the fur brushes 81 by the power supplied 15 and 16, by the controlling means 80. Here, the cleaning bias voltages applied to the bias rollers 84*a* and 84*b*, i.e., the fur brushes 81*a* and 81*b*, are stepwisely changed to thereby stepwisely change electric current values (monitor currents) applied to the fur brushes 81*a* and 81*b*.

Then, the voltage-current relations of the respective fur brushes 81*a* and 81*b* are detected by the detecting means 90. On the basis of the result of the detection by the detecting means 90, the controlling means 80 variably controls the conditions of the biases applied to the fur brushes 81*a* and 81*b*.

Again in Embodiments 2 and 3, an operational effect similar to that of Embodiment 1 can be achieved, and the setting of a cleaning bias having taken into account the influence i.e., interference, of the biases applied to the fur brushes in proximity to each other, or the influence of the charges of the upstream fur brush residual in the belt becomes possible. Further, by effecting bias control, it is possible to set a cleaning bias corresponding to a proper electric current even when for example, image formation is progressed by a plurality of fur brushes to thereby cause unevenness to the stains of the fur brushes.

This application claims priority from Japanese Patent Application No. 2004-306252 filed on Oct. 20, 2004, which is hereby incorporated by reference herein.

What is claimed is:

1. An image forming apparatus comprising:

an image bearing member, which bears a toner image;

a toner image forming unit, which forms a toner image onto the image bearing member;

a transfer unit, which electrostatically transfers the toner image on the image bearing member to a recording material;

a first cleaning member to which a voltage is applied to remove residual toner on the image bearing member after the toner image is transferred;

a second cleaning member to which a voltage is applied to remove toner from an area of the image bearing member from which the toner has been removed by the first cleaning member;

detecting means for detecting an electric current when a predetermined voltage is applied to the second cleaning member or a voltage when a predetermined electric current is applied to the second cleaning member, the predetermined voltage or the predetermined electric current being applied to the second cleaning member when the area of the image bearing member that has been contacted with the first cleaning member to which the voltage is applied is in contact with the second cleaning member; and voltage changing means for changing the voltage applied to the second cleaning member to remove the toner, based on a detection result of the detecting means.

2. An image forming apparatus according to claim 1, wherein when the toner on the image bearing member is removed, the voltage applied to the first cleaning member has a polarity different from a polarity of the voltage applied to the second cleaning member.

3. An image forming apparatus according to claim 2, wherein a polarity of the voltage applied to the first cleaning member when the detecting means detects the voltage or the electric current is the same as the polarity of the voltage applied to the first cleaning member when the first cleaning member removes the toner on the image bearing member.

4. An image forming apparatus according to claim 3, wherein a value of the voltage applied to the first cleaning member when the detecting means detects the voltage or the electric current is the same as a value of the voltage applied to the first cleaning member when the first cleaning member removes the toner on the image bearing member.

* * * * *

UNITED STATES PATENT AND TRADEMARK OFFICE

CERTIFICATE OF CORRECTION

PATENT NO. : 7,403,729 B2
APPLICATION NO. : 11/251797
DATED : July 22, 2008
INVENTOR(S) : Masanori Shida It is certified that error appears in the above-identified patent and that said Letters Patent is hereby corrected as shown below:

COLUMN 2

Line 35, “other” should read --other.--.

COLUMN 5

Line 39, “develop” should read --develops--.

COLUMN 6

Line 29, “secondary-transferred” should read --secondarily-transferred--.
Line 67, “material p.” should read --material P.--.

COLUMN 7

Line 35, “has” should read --have--.
Line 36, “is” should read --are--; and “has” should read --have a--.

COLUMN 9

Line 14, “it as” should be deleted.
Line 39, “control” should read --controls--.
Line 59, “the then” should read --then the--.

COLUMN 10

Lines 43 through 45, “the influence of residual charges in the belt the intermediate transfer belt 5 has received by the upstream cleaning fur brush **81*a*” should read --the downstream cleaning fur brush 81*b***--.

Line 46, “received by the downstream cleaning fur brush *81b*” should read --influenced by the residual charges in the intermediate transfer belt which have been imparted by the upstream cleaning fur brush **81*a***--.

Line 64, “interfere.” should read --interference.--.

UNITED STATES PATENT AND TRADEMARK OFFICE

CERTIFICATE OF CORRECTION

PATENT NO. : 7,403,729 B2
APPLICATION NO. : 11/251797
DATED : July 22, 2008
INVENTOR(S) : Masanori Shida It is certified that error appears in the above-identified patent and that said Letters Patent is hereby corrected as shown below:

COLUMN 11

Line 17, “voltage” should read --voltages--.
Line 21, “the” should read --then--.
Line 22, “then” should read --the--.
Line 27, “supplied” should read --supplies--.

Signed and Sealed this

Second Day of June, 2009

JOHN DOLL
*Acting Director of the United States Patent and Trademark Office*